US005529662A

United States Patent [19]

Tan et al.

[11] Patent Number: 5,529,662

[45] Date of Patent: Jun. 25, 1996

[54] METHOD OF BLEACHING CELLULOSIC PULPS WITH OZONE AND A PROTECTIVE AMOUNT OF AN N-ALKYLATED UREA

[75] Inventors: Zheng Tan; Marco Solinas, both of Vancouver, Canada

[73] Assignee: MacMillan Bloedel Limited, Vancouver, Canada

[21] Appl. No.: 267,947

[22] Filed: Jul. 6, 1994

[51] Int. Cl.[6] ..... D21C 9/153

[52] U.S. Cl. ..... 162/65; 162/72

[58] Field of Search ..... 162/72, 63, 65; 8/111, 195

[56] References Cited

PUBLICATIONS

Liebergott et al, "The Use of Ozone In Bleaching Wood Pulps" Pulping & Bleaching Seminar, New Orleans Nov. 1978 pp. 90–105.

*Primary Examiner*—Steven Alvo
*Attorney, Agent, or Firm*—C. A. Rowley

[57] ABSTRACT

Cellulosic pulps are bleached with ozone in an ozone bleaching stage in an aqueous medium containing an additive in an effective amount not exceeding 5% weight concentration of the aqueous medium. The additive is selected from a group consisting of N-alkylated ureas, N-alkylated lactams and N-alkylated amides. pH in the Z stage is operated under conventional ozone bleaching conditions, but preferably at high consistency and at low temperature, below 5° C.

11 Claims, 2 Drawing Sheets

METHOD OF BLEACHING CELLULOSIC PULPS WITH OZONE AND A PROTECTIVE AMOUNT OF AN N-ALKYLATED UREA

FIELD OF THE INVENTION

The present invention relates to ozone bleaching of cellulosic pulps more particularly, the present invention relates to aqueous ozone bleaching of cellulosic pulp by incorporating a small amount of a selected additive into the liquid phase of the slurry to prevent deterioration of the fibers and thereby maintain significant amount of the strength.

BACKGROUND OF THE PRESENT INVENTION

Conventional ozone bleaching of cellulosic pulps in an aqueous medium produces significant degradation of the pulp. A variety of different protectors have been suggested to be added to the slurry to protect the cellulose from ozone attack. However, most have either been ineffective in protecting or were required in very substantial amounts.

The use of alcohol such as methyl-alcohol in the aqueous medium surrounding the pulp fibers during the ozone bleaching stage was suggested a number of years ago but was not found to be particularly effective until recently when applied in a particular manner to obtain significant improvement in pulp viscosity (strength) after the ozone stage relative to what could be obtained using conventional ozone bleaching (see U.S. patent application Ser. No. 08/056,496 filed by Solinas et al. on May 3, 1993).

It is also known to operate the ozone bleaching stage at a temperature below room temperature as described in the Kobayashi reference and as further discussed in U.S. patent application Ser. No. 08/024,056 filed Mar 1, 1993 by van Heiningen et al, now abandoned.

BRIEF DESCRIPTION OF THE PRESENT INVENTION

It is an object of the present invention to provide an aqueous system for ozone bleaching of cellulosic pulp using small quantities of an additive that protects the cellulose from degradation by the ozone thereby whereby an ozone bleached pulp of improved strength characteristics may be produced.

Broadly, the present invention relates to a method of bleaching cellulosic pulps in an aqueous medium comprising adding to an aqueous slurry of said pulp an effective amount not exceeding a concentration of 5% in said aqueous medium of an additive selected from the group consisting of water soluble N-alkylated ureas, N-alkylated lactams, N-alkylated amides, phosphorus analogues of N-alkylated amides, and mixtures thereof, and bleaching said pulp in an ozone bleaching stage at a pH of between 1.5 and 4 and at a consistency of between 2% and 50% to consume the required amount of ozone and form an ozone bleached pulp.

Preferably, said N-alkylated lactams will be selected from the group consisting of alkylated pyrrolidinones, alkylated piperidinones, alkylated caprolactams.

Preferably, said N-alkylated amides will be selected from the group consisting of fully-substituted open chain amides (e.g. dimethyl acetamide), cyclic alkylated amides (e.g. N-acylated pyrrolidines, N-acylated piperidines or N-acylated morpholines) and phosphorus analogues of said N-alkylated amides (e.g. hexamethyl phosphoric amide, HMPA).

More preferably, said additive will be selected from a group consisting of tetramethyl urea, tetraethyl urea, dimethylpropylene urea, dimethylethylene urea, N-cyclohexyl pyrrolidinone, N-methyl pyrrolidinone, dimethyl acetamide and hexamethyl phosphoric amide.

Most preferably, said additive will be selected from the group consisting of N-cyclohexyl pyrrolidinone and tetramethyl urea.

Preferably, said consistency will be in the range of about 20% or 45%.

Preferably, said additive will be added in the amount to produce a concentration of additive in said medium of less than 3%.

Preferably, the temperature in the ozone stage will be maintained below 5° C.

BRIEF DESCRIPTION OF THE DRAWINGS

Further features, objects and advantages will be evident from the following detailed description of the preferred embodiments of the present invention taken in conjunction with the accompanying drawings in which.

DESCRIPTION OF THE PREFERRED EMBODIMENTS

Figure 1:
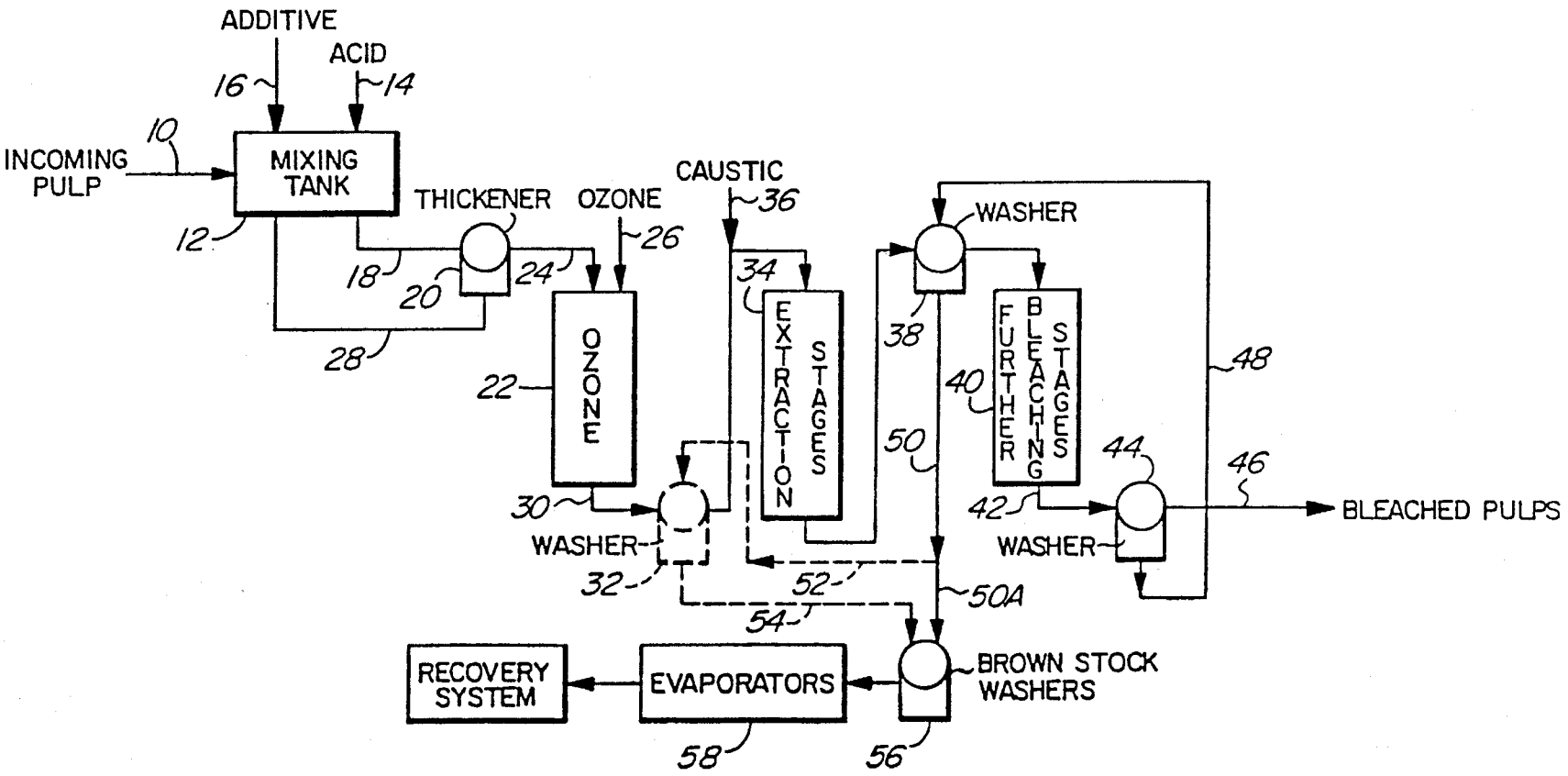
FIG. 1 is a schematic flow diagram for carrying out the process of the present invention.

As illustrated in FIG. 1, the pulp to be bleached is introduced as indicated by line 10 and is mixed in vessel 12 with a suitable acid introduced as indicated by line 14 (normally a mineral acid such as sulphuric acid) and with a suitable additive (to be described below) introduced as indicated by line 16. The conditioned pulp containing the required amount of acid, i.e. at the desired pH which will normally be in the range about 1.5 to 4 and carrying the required amount of additive in the surrounding aqueous medium (as will be described hereinbelow) is fed via line 18 to the thickener 20 wherein the consistency of the pulp is increased to that desired for application of ozone in the ozone bleaching stage (Z stage) 22. In the illustrated arrangement, the pulp from thickener 20 is taken via line 24 and introduced into the ozone stage 22 to which ozone is introduced as indicated via line 26. Obviously, depending on the consistency in the ozone stage 22, the pulp will (at higher consistencies) be fluffed by the introduction to the stages.

The pulp in the line 24 will be at the desired consistency and will contain the additive at a concentration (by weight) in the aqueous medium of less than 5% preferably less than 3% by weight, generally between 0.5 and 2.5% and most preferably between 1 and 2% based on weight of additive in the aqueous medium.

The ozone stage 22 is operated under any suitable operating condition to consume the required amount of ozone, generally less than 4%. The condition will normally be those conventionally used for ozone bleaching, i.e. pH 1.5–4, temperature 20°–30° C. or preferably at low temperature of less than 5° C. and preferably under high consistency, i.e. 30%–50% consistency.

By operating the Z stage 22 at high consistency, i.e. in the range of about 30 to 50% consistency of pulp in medium, and by maintaining the concentration of the additive in the medium below about 5% (depending on the additive) and preferably less than 3%, the total amount of additive used can be maintained relatively low; specifically, i.e. to an amount that may require no added or special provisions for recovery. For example, the effluent containing the additive may simply be fed to the recovery system of the pulp mill in the conventional manner together with other recovered flows as will be described below.

In any event, liquor or medium separated from the pulp in the thickener 20 is returned via line 28 to the vessel 12 to be reused in providing the required amounts of acid and additives to the incoming pulp (which will normally be at a consistency in the order of about 30%) i.e. so that only make-up acid and additive need be added via lines 14 and 16 respectively.

The pulp bleached in the ozone stage (Z stage) 22 is carried via a line 30 and preferably is washed as indicated at 32 and then delivered to an extraction stage (E stage) 34. Preferably, caustic will be added as indicated at 36 to the extraction stage so that the pH of the extraction stage is increased to an alkaline pH, preferably in the order of 10.5–11 at the end of the extraction. (Other additive such as peroxide or oxygen may be applied to the pulp in the extraction stage.) The extracted pulp may then be washed as indicated at 38 and further bleached in stages 40 as required to obtain final brightness of the pulp.

The fully bleached pulp passes from bleaching stages 40 via line 42 and is washed by the washing stage 44 and leaves the system via line 46.

The effluent from washer 44 is delivered to washer 38 via line 48 and used as a washing fluid in the washer 38. The effluent from washer 38 is carried via line 50 (in counter current to the direction of pulp flow through the system) either to washer 32 as indicated by dotted line 52 and the effluent from washer 32 returned to the recovery system via line 54 or passes directly via line 50A to the recovery system.

Preferably, the effluent in line 50A and/or 54 will be directed to and used as washing fluid in the brown stock indicated at 56 then sent to a set of multiple effect evaporators 58 and finally any residual will be introduced to the recovery furnace and function in part as a fuel.

As above indicated, it is important that the amount of additive in the system be maintained sufficient to effectively protect the pulp, yet relatively low for ecological and economic reasons to permit the system to operate within the required constraints without requiring the reuse of the additive which would require additional separating equipment to isolate the additive for recovery.

It has been found that additives selected from the group consisting of N-alkylated lactams, N-alkylated ureas and N-alkylated amides and mixtures thereof meet the requirement of the present invention. More preferably, the additive will be selected from the group consisting of tetramethyl urea, tetraethyl urea, dimethylpropyleneurea, dimethylethyleneurea, N-cyclohexylpyrrolidinone, N-methyl pyrrolidinone, dimethyl acetamide and hexamethyl phosphoric amide. Most preferably, the additive will be selected from the group consisting of N-cyclohexyl pyrrolidinone and tetramethyl urea.

When N-alkylated ureas are used, the degree of substitution must be sufficiently high or the molecular size of the substitution sufficiently large or the protective effect of the invention may be lost; similarly, the N-alkylated amides must be fully substituted to ensure the effect, and these terms are intended to be interpreted accordingly.

The process may be carried out at the normally used temperature in the Z stage i.e. about 20° C., but it is preferred to maintain the temperature of the ozone stage relatively low, e.g. 0° to +5° C.

It is being found that a viscosity gain of up to about 8 centipose (cp) may be obtained for example, using tetramethyl urea at a temperature of 1° C. over the viscosity attainable when the medium used is water substantially free of the additive.

EXAMPLES

A mill produced softwood kraft pulp brown stock having a kappa number of 28 ml and a viscosity of 28 cp was used in all the tests. Ozone bleaching was carried out at high consistency (38% to 41%). The extraction was done at 70° C. for one hour with 1.5% alkali applied to the pulp at 10% consistency.

Example 1

Different concentrations of tetramethyl urea were applied in the range of from 0.5% to 10% based on weight of liquid (water and additive) in the ozone stage.

Figure 2:
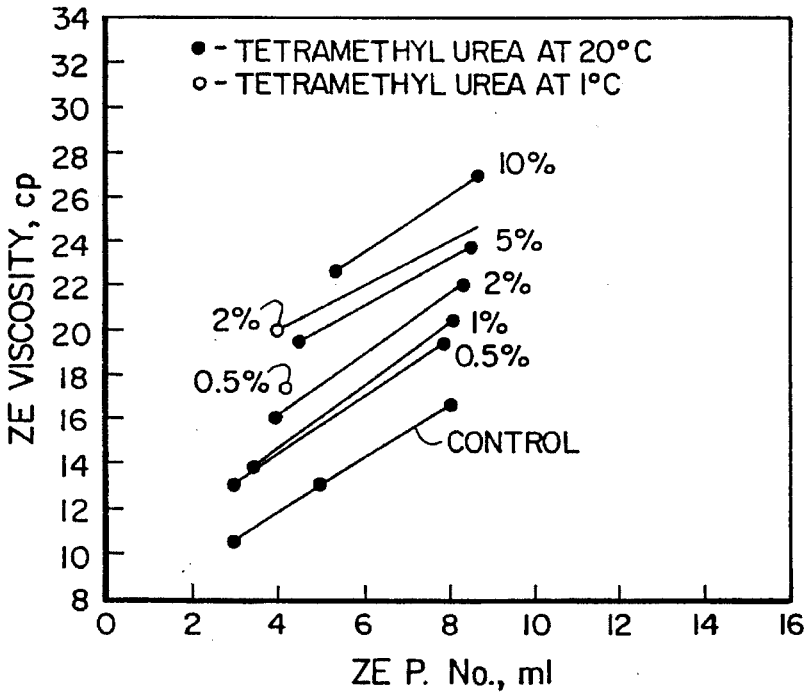
FIG. 2 is a graph of pulp viscosity in centipoises (cp) after an extraction stage following the Z stage plotted against permanganate number (P. no.) in millilitres (ml) for a pulp bleached using tetramethyl urea at a Z stage temperature of 20° C. and 20 C.

The results are presented in Table 1 and some are plotted for the application of 1% and 2% ozone in FIG. 2. Also, in Table 1 and FIG. 2, there is one test (0.5% tetramethyl urea at 1° C.) which has been done with 1.5% ozone application. It can be seen that at 20° C., the viscosity gain over the control ranges from about 2.5 cp to about 9.5 cp as the tetramethyl urea concentration increases from 0.5% to 10%.

However, as the tetramethyl urea concentration is increased above 2%, the delignification is increasingly retarded. This effect of retardation is more obvious with 2% ozone application than with 1% ozone application.

At the lower temperatures, i.e. 1° C., an application of 2% tetramethyl urea shows a significant improvement in viscosity (in the order of 8 cp at a permanganate number of about 4 ml); even with 0.5% tetramethyl urea, a viscosity gain of 5 cp can be achieved (see FIG. 2).

TABLE 1

| | | | Tetramethyl Urea | | | | | |
|---|---|---|---|---|---|---|---|---|
| Tetramethyl Urea % on Liquid | Ozone Applied on O.D. Pulp % | Ozone Consumed % on O.D. Pulp | Z Stage P. No. | Z Stage Viscosity cp | Z stage Brightness ISO | ZE Stage P. No. | ZE Viscosity cp | ZE Brightness ISO |
| 0 | 1.0 | 0.80 | 11.2 | 16.4 | 41.1 | 7.9 | 16.5 | 42.0 |

TABLE 1-continued

| Tetramethyl Urea % on Liquid | Ozone Applied on O.D. Pulp % | Ozone Consumed % on O.D. Pulp | Tetramethyl Urea: Z Stage P. No. | Z Stage Viscosity cp | Z stage Brightness ISO | ZE Stage P. No. | ZE Viscosity cp | ZE Brightness ISO |
|---|---|---|---|---|---|---|---|---|
| (20° C.) | 1.5 | 1.2 | 7.9 | 13.5 | 48.5 | 4.9 | 13.1 | 51.3 |
| | 2.0 | 1.5 | 5.8 | 11.1 | 53.9 | 3.8 | 10.5 | 58.6 |
| 0.5 | 1.0 | 0.86 | 10.9 | 18.8 | 40.2 | 7.8 | 19.3 | 44.0 |
| (20° C.) | 2.0 | 1.5 | 5.6 | 13.5 | 55.5 | 3.0 | 13.1 | 60.3 |
| 1 | 1.0 | 0.83 | 11.2 | 20.6 | 39.9 | 8.1 | 20.4 | 43.6 |
| (20° C.) | 2.0 | 1.5 | 5.7 | 13.5 | 54.0 | 3.5 | 13.7 | 58.0 |
| 2 | 1.0 | 0.85 | 11.3 | 21.8 | 39.3 | 8.3 | 21.8 | 42.0 |
| (20° C.) | 2.0 | 1.6 | 5.6 | 16.4 | 53.4 | 3.8 | 16.0 | 56.0 |
| 5 | 1.0 | 0.85 | 11.4 | 23.5 | 40.4 | 8.4 | 23.7 | 43.1 |
| (20° C.) | 2.0 | 1.6 | 7.3 | 19.1 | 50.0 | 4.5 | 19.4 | 52.5 |
| 10 | 1.0 | 0.87 | 11.3 | 24.1 | 40.0 | 8.7 | 26.9 | 42.8 |
| (20° C.) | 2.0 | 1.6 | 8.5 | 21.7 | 47.5 | 5.3 | 22.5 | 51.0 |
| 2 | 1.0 | 0.87 | 11.1 | 22.1 | 40.5 | 7.7 | 23.6 | 42.5 |
| (1° C.) | 2.0 | 1.6 | 7.4 | 18.0 | 50.6 | 4.1 | 20.1 | 53.5 |
| 0.5 (1° C.) | 1.5 | 1.2 | 6.2 | 16.8 | 50.2 | 4.2 | 17.3 | 53.5 |

Temperature in brackets = temperature in the Z stage.

Example 2

Figure 3:
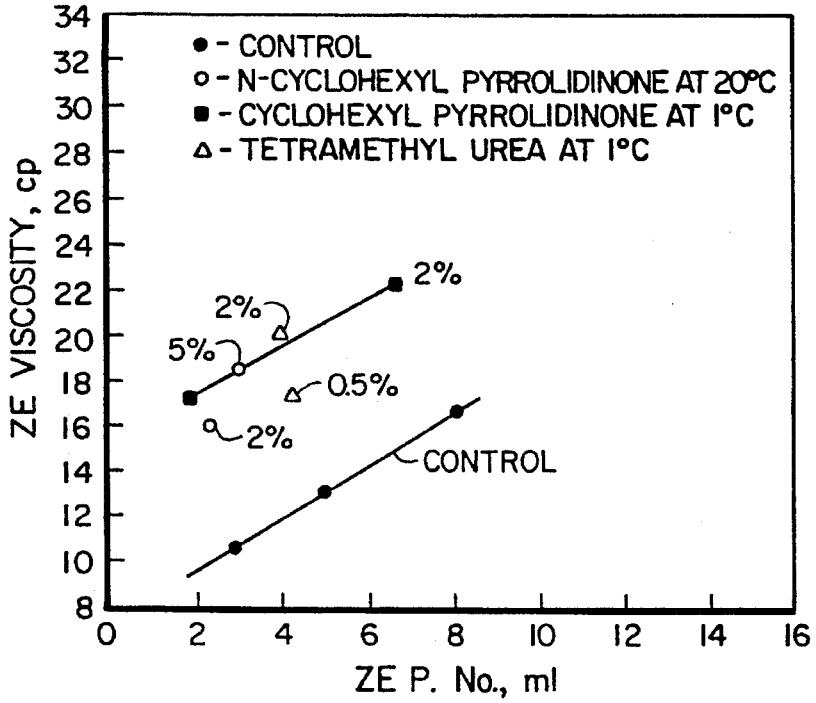
FIG. 3 is a graph similar to FIG. 2 showing results with different additives at different temperatures and applied in different amounts.

Better viscosity gains were obtained using N-cyclohexyl pyrrolidines as shown in Table 2 and FIG. 3 rather than tetramethyl urea.

Example 3

As shown in FIG. 3, cyclohexyl pyrrolidine gives very similar results to that obtained using tetramethyl urea at 1° C. for a 2% application of the additive in a liquid and are about equivalent to 5% N-cyclohexyl pyrrolidine at 20° C.

It is also seen from Table 2 and FIG. 3, there is a distinct advantage in using N-cyclohexyl pyrrolidinone in that the delignification is enhanced over the control as evident by the permanganate number reduction and the brightness development.

TABLE 2

| Additive % on Liquid | Ozone Applied on O.D. Pulp % | Ozone Consumed % on O.D. Pulp | N-cyclohexyl Pyrrolidinone: Z Stage P. No. | Z Stage Viscosity cp | Z stage Brightness ISO | ZE Stage P. No. | ZE Stage Viscosity cp | ZE Stage Brightness ISO |
|---|---|---|---|---|---|---|---|---|
| 2, 20° C. | 2.0 | 1.66 | 4.2 | 15.1 | 61.6 | 2.3 | 15.8 | 62.6 |
| 5, 20° C. | 2.0 | 1.62 | 4.9 | 17.4 | 60.0 | 2.8 | 18.5 | 60.8 |
| 2, 1° C. | 1.0 | 0.88 | 10.5 | 22.3 | 44.4 | 6.7 | 22.2 | 45.4 |
| | 2.0 | 1.62 | 4.6 | 17.9 | 62.3 | 1.9 | 17.4 | 63.0 |

Having described the invention, modifications will be evident to those skilled in the art without departing from the scope of the invention as defined in the appended claims.

We claim:

1. A method of bleaching cellulosic pulps in an aqueous medium comprising adding to an aqueous slurry of said pulp an effective amount not exceeding a concentration of 5% in said aqueous medium of an N-alkylated urea as an additive and bleaching said pulp in an ozone bleaching stage at a pH of between 1.5 and 4 and at a consistency of between 2% and 50% to consume the required amount of ozone and form an ozone bleached pulp, wherein the additive is added in an amount effective to protect the cellulose from degradation by the ozone.

2. A method as defined in claim 1 wherein said consistency is in the range of about 20% or 45%.

3. A method as defined in claim 1 wherein said additive is added in an amount to produce a concentration of additive in said medium of less than 3%.

4. A method as defined in claim 1 wherein the temperature in said ozone stage is maintained below 5° C.

5. A method as defined in claim 1 wherein said additive is selected from a group consisting of tetramethyl urea, tetraethyl urea, dimethylpropylene urea.

6. A method as defined in claim 2 wherein said additive is added in an amount to produce a concentration of additive in said medium of less than 3%.

7. A method as defined in claim 2 wherein the temperature in said ozone stage is maintained below 5° C.

8. A method as defined in claim 2 wherein said additive is selected from a group consisting of tetramethyl urea, tetraethyl urea, dimethylpropylene urea.

9. A method as defined in claim 3 wherein the temperature in said ozone stage is maintained below 5° C.

10. A method as defined in claim 3 wherein said additive is selected from a group consisting of tetramethyl urea, tetraethyl urea, dimethylpropylene urea.

11. A method as defined in claim 4 wherein said additive is selected from a group consisting of tetramethyl urea, tetraethyl urea, dimethylpropylene urea.

* * * * *